United States Patent [19]

Ozanne

[11] 4,037,379

[45] July 26, 1977

[54] WALL PANEL

[76] Inventor: Leroy Ozanne, 15800 S. Woodland, Shaker Hts., Ohio 44120

[21] Appl. No.: 703,640

[22] Filed: July 8, 1976

[51] Int. Cl.[2] ..... E04B 1/74; E04C 1/16; E04C 1/10

[52] U.S. Cl. ..... 52/404; 52/488; 52/580; 52/593; 52/615; 52/618; 52/735; 52/625

[58] Field of Search ..... 52/580, 618, 619, 624–628, 52/349, 290, 241, 615, 617, 309, 404, 221, 735, 589, 593, 516, 488

[56] References Cited

U.S. PATENT DOCUMENTS

| | | | |
|---|---|---|---|
| 1,159,411 | 11/1915 | Olberg | 52/619 |
| 1,240,634 | 9/1917 | Williams | 52/625 |
| 1,578,344 | 3/1926 | Munroe | 52/618 |
| 1,917,871 | 7/1933 | Birt | 52/619 |
| 2,275,109 | 3/1942 | McGee | 52/735 |
| 2,613,768 | 10/1952 | Gillett | 52/580 |

FOREIGN PATENT DOCUMENTS

| | | | |
|---|---|---|---|
| 617,621 | 2/1949 | United Kingdom | 52/593 |

*Primary Examiner*—James L. Ridgill, Jr.
*Attorney, Agent, or Firm*—Woodling, Krost, Granger & Rust

[57] ABSTRACT

A wall panel including in combination first and second generally parallel and spaced end members each having a channel shaped cross section. In the normal orientation of the wall panel, the end members are positioned horizontally. First and second positioning tabs are located on opposed end portions of each of the first and second end members. First and second generally parallel and spaced side members are provided and in the normal orientation of the wall panel these side members are located in a vertical position. The first side member has a channel shaped cross section and has opposed ends thereof engaging the first positioning tabs on the first and second end members and they are fixedly secured thereto. The second side member has a box shaped cross section and has opposed ends thereof engaging the second positioning tabs on the first and second end members and they are fixedly secured thereto.

A portion of the box shaped cross section of the second side member overhangs the extreme ends of the first and second end members and this portion is adapted to be received in the channel shaped cross section of a first side member of another panel. The wall panel is adapted to receive dry wall on either side thereof which may be secured in place by an adhesive or other mechanical means and insulation is adapted to be received between the two layers of dry wall.

15 Claims, 10 Drawing Figures

FIG. 2
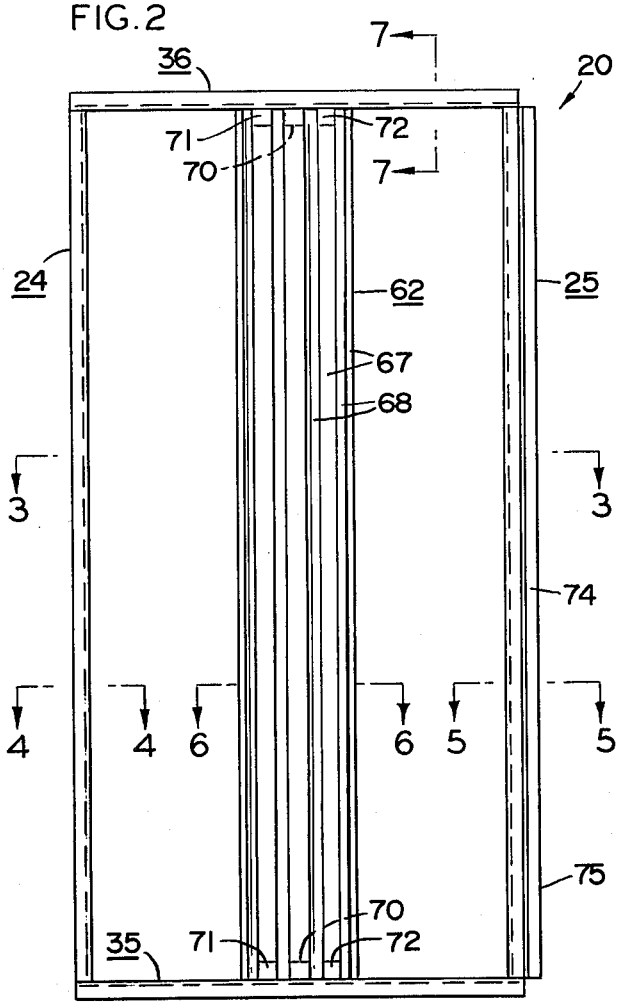
FIG. 4
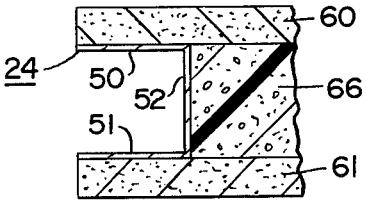
FIG. 5
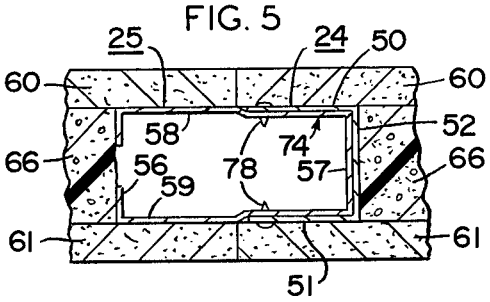
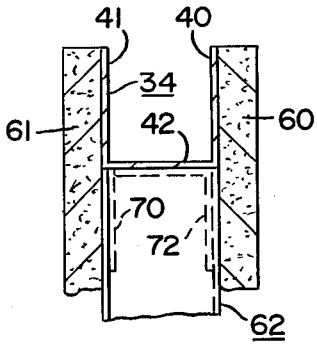
FIG. 7
FIG. 3
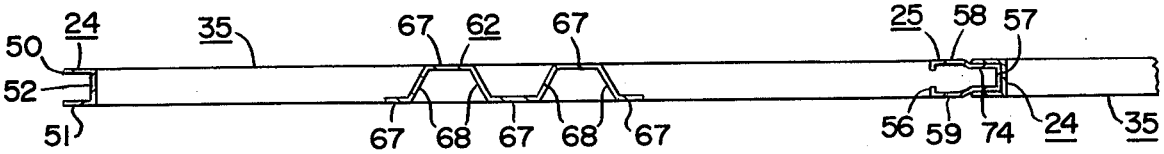
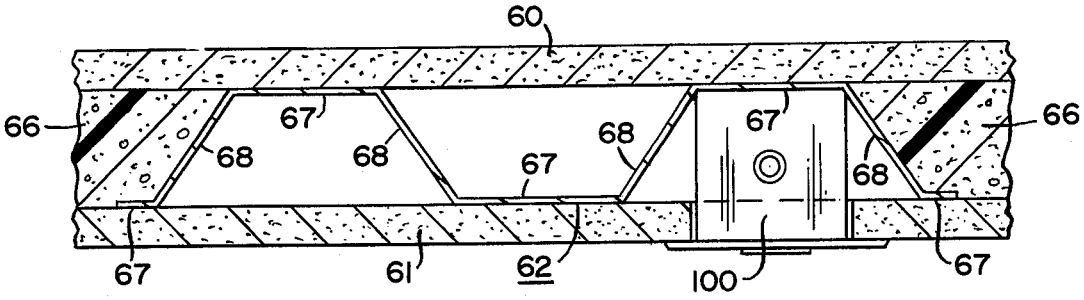
FIG. 6

FIG. 8
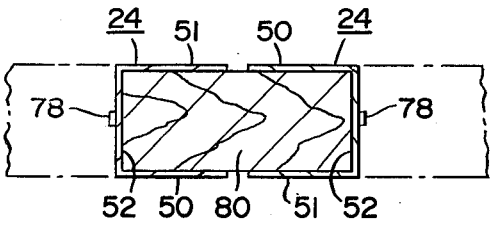
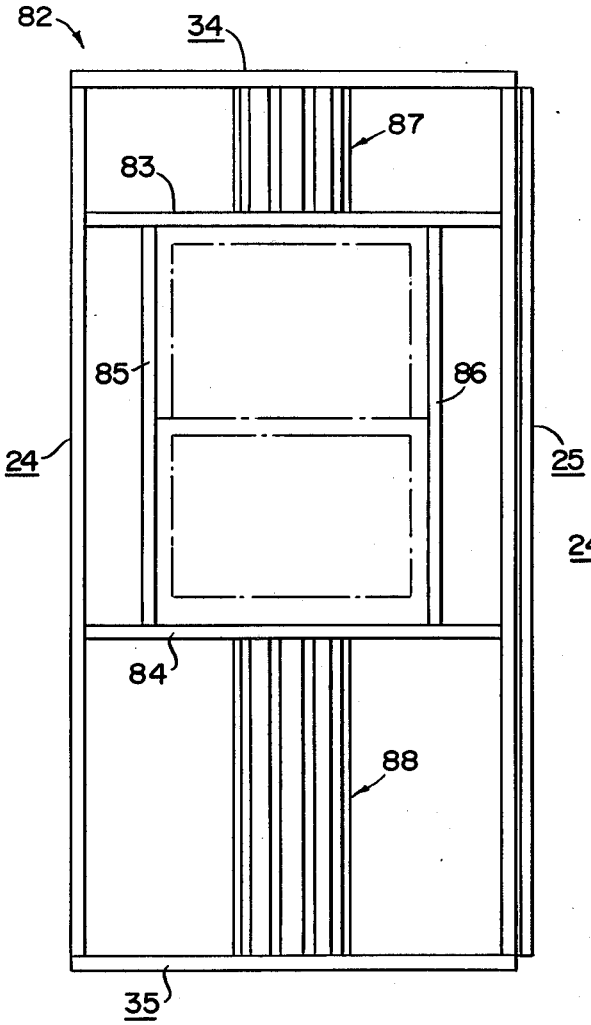
FIG. 9
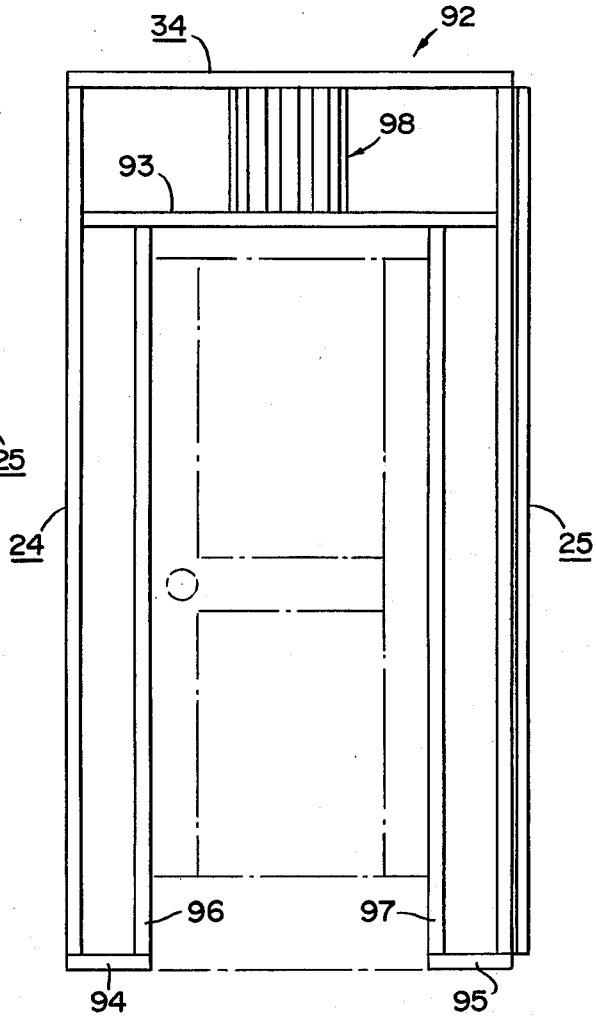
FIG. 10

WALL PANEL

The present invention relates generally to the building industry and has to do with a wall panel which can be used to erect original construction or rehabilitate presently existing construction which is in need of repair.

The panel comprises a strong, preferably welded, steel construction, made up of a minimum number of components and results in an extremely strong construction. In one embodiment of the present invention the basic panel construction involves the use of only four different components which are easily assembled by unskilled labor and secured together by welding, screws or other mechanical means. Electrical components can be formed as part of the wall panel as it is factory mass produced and drywall may be glued or otherwise secured to either side of the panel. Likewise, insulation can be interposed between the two layers of drywall.

The panel of this invention can be factory mass produced by semi-skilled workers at substantial savings over present on the job erected structures. Additionally, the preferable steel nature of the components results normally in a stronger structure, and which in many environments is more resistant to weather conditions and attacks by insects and the like.

The panel can be readily modified as disclosed herein to provide for the reception of a window or a door frame. Other advantages will be apparent upon review of the disclosure.

Other objects and a fuller understanding of this invention may be had by referring to the following description and claims, taken in conjunction with the accompanying drawings, in which:

FIG. 2 is a front elevational view of the wall panel of the present invention;

FIG. 3 is a view taken generally along the line 3—3 of FIG. 2 with the exception that an additional wall panel is shown connected to the right end of the wall panel of FIG. 2 to illustrate the means of connection;

FIG. 4 is a view taken generally along the line 4—4 of FIG. 2 and illustrating drywall secured to either side of the wall panel and insulation between the drywall;

FIG. 5 is a view taken generally along the line 5—5 of FIG. 2 and illustrating dry wall attached to either side of the wall panel and, also, illustrating the connection to another wall panel as illustrated in FIG. 3;

FIG. 6 is a view taken generally along the line 6—6 of FIG. 2 and showing dry wall attached to either side of the wall panel;

FIG. 7 is an enlarged view taken generally along the line 7—7 of FIG. 2 and showing dry wall attached to either side of the wall panel;

FIG. 8 is a view similar to FIG. 5 but showing a different means of connecting two adjacent wall panels together;

FIG. 9 is an elevational view showing the wall panel of FIGS. 1 and 2 modified so as to provide a window opening or window frame opening; and FIG. 10 is an elevational view showing the wall panel of FIGS. 1 and 2 modified to provide a door opening or door frame opening.

Figure 1:
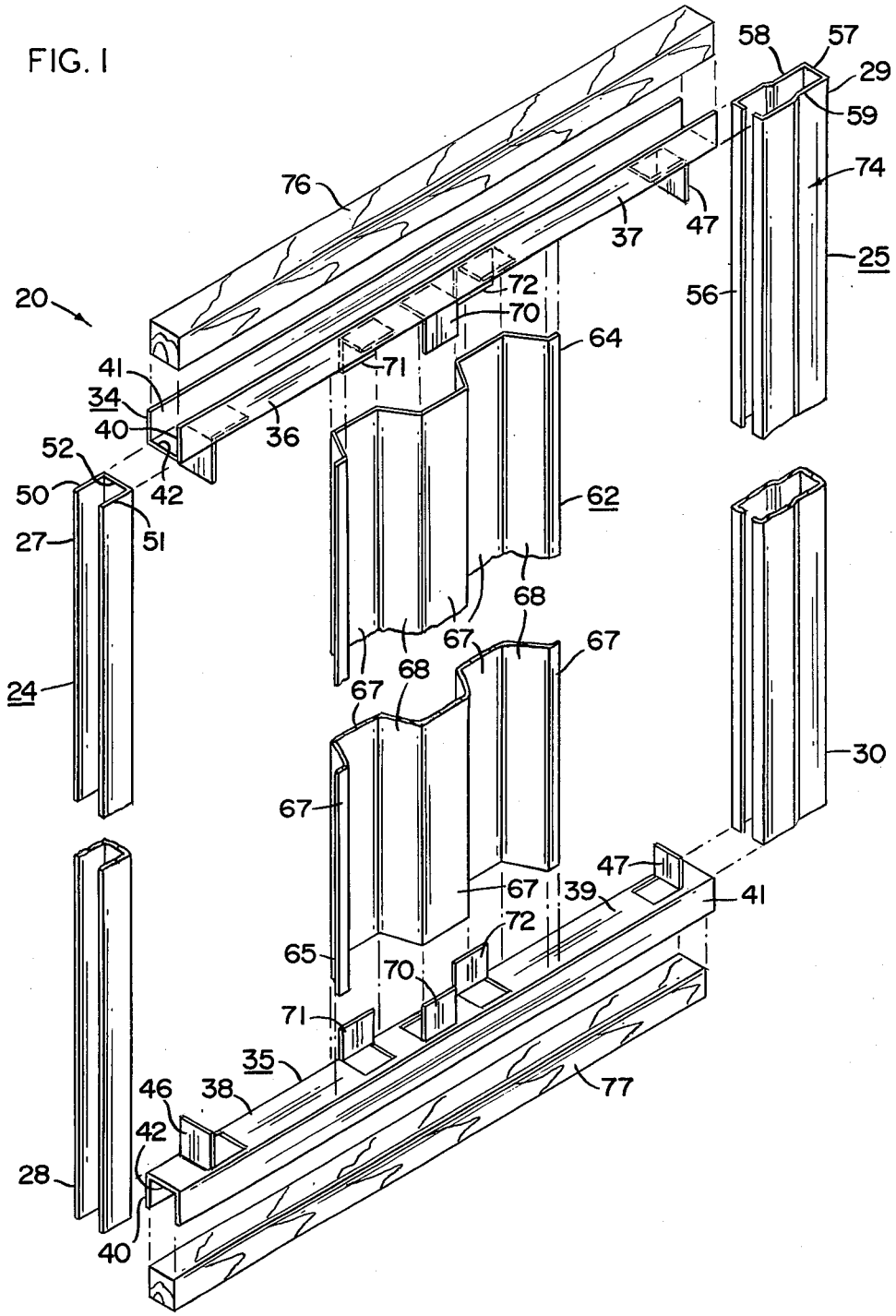
FIG. 1 is an exploded fragmentary isometric view of the wall panel of the present invention.

The teachings of the present invention are illustrated in all of the accompanying drawings and it will be seen that the structure comprises a generally rectangularly shaped building wall panel identified generally by the reference numeral 20. The panel is made preferably of steel components that can be suitably connected together by conventional means such as by spot welding, by screws or other mechanical means. The wall panel includes in combination first and second spaced and parallel side frame members identified by the reference numerals 24 and 25, respectively, and each of the side frame members has first and second end portions. The first and second end portions of side frame member 24 are identified by reference numerals 27 and 28, respectively, and the first and second end portions of side frame member 25 are identified by the reference numerals 29 and 30, respectively. First and second spaced and parallel end frame members 34 and 35 are provided with end frame member 34 having first and second end portions 36 and 37, respectively, and with end frame member 35 having first and second end portions 38 and 39, respectively. In the preferred embodiment of the invention the end frame members 34 and 35 are identical in construction and each comprises a channel shaped metal member having a bottom wall 42 and first and second side walls 40 and 41, respectively. A generally rectangularly shaped side member positioning tab is formed at each of the first and second end portions of each of the end frame members 34 and 35 and the positioning tabs are identified by the reference numerals 46 and 47, respectively. It will be seen that the positioning tabs 46 and 47 are formed from the metal of the bottom wall 42 and are bent upward so as to extend normal to the bottom wall and, also, normal to the longitudinal extent of the channel shaped member of which the end frame members 34 and 35 are formed.

The first side frame member 24 is, also, comprised of a channel shaped metal construction having a bottom wall 52 and first and second side walls 50 and 51, respectively. The first end portion 27 of the first side frame member 24 engages the first end portion 36 of the first end frame member 34 with the bottom wall of the channel shaped metal member of the first side frame member 24 engaging the side member positioning tab 46 thereat and is fixedly secured thereto by means of spot welding. The second end portion 28 of the first side frame member 24 engages the first end portion 38 of the second end frame member 35 with the bottom wall 52 of the channel shaped member of the first side frame member 24 engaging the side member positioning tab 46 thereat and is fixedly secured thereto by spot welding.

The second side frame member 25 comprises a generally box-shaped metal member having first and second end walls 56 and 57, respectively, connected by first and second side walls 58 and 59, respectively. It will be observed that the side walls 58 and 59 are necked in as at 74 so as to provide two sections of different width or thickness. The first end portion 29 of the second side frame member 25 engages the second end portion 37 of the first end frame member 34 with the first end wall 56 of the box-shaped metal member of the second side frame member engaging the side member positioning tab 47 thereat and is fixedly secured thereto in the same manner as side frame member 24 is secured to end frame members 34 and 35. The second end portion 30 of the second side frame member 25 engages the second end portion 39 of the second end frame member 35 with the first end wall 56 of the box-shaped metal member of the second side frame member engaging the side member positioning tab 47 thereat and it is fixedly secured in position in the same manner as the other end portion 29.

A corrugated metal structural member 62 is provided which has first and second end portions 64 and 65, respectively. The first end portion 64 of the corrugated structural member 62 engages the first end frame member 34 intermediate the first and second end portions thereof and the second end portion 65 engages the second end frame member 35 intermediate the first and second end portions thereof. Additional tabs are formed from the bottom wall 42 of each of the first and second end frame member 34 and 35, respectively, and these additional tabs are three in number and have been identified by the reference numerals 70, 71 and 72. These tabs are so formed as to lie in a plane which is generally parallel to the longitudinal extent of the channel shaped first and second end frame members. It will be noted that the tabs 70 are located on one side of the frame members and the tabs 71 and 72 are located on the other side. The corrugated structural member 62 is made up of a plurality of flat parallel walls 67 interconnected by diagonally extending walls 68 and the corrugated structural member 62 is secured in position by means of the tabs 70 being spot welded to a wall 67 on one side of the end frame member with tabs 71 and 72 being spot welded to two spaced walls 67 on another side of the frame members 34 and 35. It will, also, be observed that the corrugated metal structural member has a width or extent which is less than the distance between the first and second side frame members 24 and 25. This assists in keeping the side frame members and the end frame members in the same plane and, also, gives sufficient structural strength so that the wall panels can be used as a load bearing members.

Referring specifically to FIGS. 3 and 5, it will be noted that the necked in portion 74 of the second side frame member 25 forms a portion identified by the reference numeral 75 of the box-shaped metal member which includes the second end wall 57 and portions of the side walls 58 and 59 outboard of the necked in portion, which overhangs the second end portions 37 and 39 of the first and second end frame members 34 and 35 to locate it in position to be received into the channel shaped metal member defined by walls 50, 51 and 52 of the first side frame member 24 of another building panel adjacent thereto. This is seen in FIGS. 3 and 5 of the drawings. The two adjacent wall panels can be appropriately permanently secured together by the expedient of screws 78 extending through the walls of the two members as illustrated in FIG. 5.

After each of the wall panels has been constructed in the manner indicated above, it is then desirable in some instances to weld or otherwise attach electrical components 100 to the panel and this has been illustrated in FIG. 6 of the drawings where a junction box has been located with the confines or within the width dimension of the corrugated structural member 62, which does away with the necessity of having these electrical components installed at the job site.

It is, also, desirable at times to provide first and second sheets of dry wall 60 and 61 on either side of the finished wall panel with insulation 66 in the nature of a foamed plastic material between the sheets of dry wall. The insulation may be foamed polystyrene. FIG. 1 illustrates the use of a 2 × 2 wooden ceiling runner 76 to secure the wall panel at its upper end portion and a 2 × 2 wooden floor runner 77 to secure the lower end portion of the wall panel in position.

FIG. 8 is a view taken at the same position and in the same direction as the view shown in FIG. 5, but illustrates a modification in the means of connecting two wall panels together. In this embodiment the two side frame members of each wall panel are both comprised of a construction identical to the first side frame member 24 shown in FIG. 1 and when this construction is used a wood 2 × 4 80 is inserted into the channel shape of each of the side frame members 24 and the two wall panels are secured together in this manner with nails 78 being used to connect the parts together.

FIGS. 9 and 10 illustrate how the wall panel of FIGS. 1 through 8 can be modified to provide proper framing for the reception of a window (FIG. 9) or a door (FIG. 10).

Referring specifically to FIG. 9, the same reference numerals have been applied to this figure where the structure is identical to that shown in FIG. 1 and where the structure differs new reference numerals have been applied. It will, therefore, be seen from referring to FIG. 9 that there is shown a panel identified by the reference numeral 82 which includes first and second side frame members 24 and 25, respectively, and first and second end frame members 34 and 35, respectively, secured together in a manner like that shown and described in conjunction with FIG. 1. This structure, however, includes two additional end frame members identified by the reference numerals 83 and 84 positioned as shown which serve to define the upper and lower extremities of a frame for the reception of a window frame and two side frame members 85 and 86 are secured to the end frame members 83 and 84 to provide the side extremities for the window frame. Members 85 and 86 are each identical in cross section to frame member 24; however, they could be identical to frame member 25. Corrugated structural members 87 and 88 which are identical in cross section to the corrugated structural member 62 are, respectively, interposed between end frame members 34 and 83 and end frame members 35 and 84. The panel 82 is an in-factory constructed panel, which when installed on the job is ready for the immediate reception of a window.

FIG. 10 illustrates the adaptation of the present invention to the production of a frame for the reception of a door. The panel illustrated in FIG. 10 has been identified generally by the reference numeral 92 and it includes an end frame member 34 and first and second side frame members 24 and 25, respectively. Additionally, there is provided an end frame member 93 which is identical in construction to that identified in FIG. 1 as a frame members 34 and 35 and end frame members 94 and 95 are, also, provided; however, they are relatively short in their longitudinal extent, but are identical in cross section to end frame members 34 and 35. Two side frame members 96 and 97, which are identical in cross section to side frame member 24 are provided and these are all interconnected as will be readily understood from reviewing FIG. 10. Additionally, in this construction there is provided a corrugated structural member 98 similar to member 62 shown in FIG. 1 and members 87 and 88 shown in FIG. 9. This interconnection of the same type of members as illustrated in FIG. 1 shows the ease with which the wall panel can be adapted to form the frame of a door.

It will be readily apparent to those skilled in the art after a review of the above description and additionally resorting to the drawings, that the wall panel comprises a very strong welded steel construction which is made up of a minimum number of components and provides a load bearing structure. The present panel can be factory massed produced by semi-skilled workers at substantial savings over present on the job erected structures. The present structure is more reliable in many environments where it is resistant to weather conditions and attacks by insects and the like. The panel as illustrated in FIGS. 9 and 10 can be readily modified to provide proper framing for the reception of a window or a door and, of course, other variations and modifications will be apparent to those skilled in the art, but which still reside within the teachings of the present invention.

What is claimed is:

1. A generally rectangularly shaped building wall panel including in combination: first and second spaced and parallel side frame members each having first and second end portions, first and second spaced and parallel end frame members each having first and second end portions, said end frame members being identical in construction, each said end frame member comprising a channel shaped metal member having a bottom wall and first and second sidewalls, a generally rectangularly shaped side member positioning tab formed from said bottom wall of said channel shaped metal member at each of said first and second end portions of each of said end frame members, said side member positioning tabs extending normal to said bottom wall and normal to the longitudinal extent of said channel shaped metal member, said first side frame member comprising a channel shaped metal member having a bottom wall and first and second sidewalls, said first end portion of said first side frame member engaging said first end portion of said first end frame member with said bottom wall of said channel shaped metal member of said first side frame member engaging said side member positioning tab thereat and being fixedly secured thereto, said second end portion of said first side frame member engaging said first end portion of said second end frame member with said bottom wall of said channel shaped metal member of said first side frame member engaging said side member positioning tab thereat and being fixedly secured thereto, said second side frame member comprising a generally box shaped metal member having first and second end walls connected by first and second sidewalls, said first end portion of said second side frame member engaging said second end portion of said first end frame member with said first end wall of said box shaped metal member of said second side from member engaging said side member positioning tab thereat and being fixedly secured thereto, said second end portion of said second side frame member engaging said second end portion of said second end frame member with said first end wall of said box shaped metal member of said second side frame member engaging said side member positioning tab thereat and being fixedly secured thereto, a corrugated metal structural member having first and second end portions, said first end portion of said corrugated structural member engaging said first end frame member intermediate said first and second end portions thereof, said second end portion of said corrugated structural member engaging said second end frame member intermediate said first and second end portions thereof, additional tabs located at said intermediate portions of said first and second end frame members, said additional tabs being formed from said bottom wall of said channel shaped metal members and lying in a plane generally parallel to the longitudinal extent of said channel metal members, said additional tabs being fixedly secured to said first and second end portions of said corrugated metal structural member to secure the same to said first and second end frame members, said corrugated metal structural member having a width less than the distance between said first and second side frame members, a portion of said box shaped metal member of said second side frame member including said second end wall and portion of said first and second sidewalls overhanging said second end portions of said first and second end frame members in position to be received in the channel shaped metal member of the first side frame member of another building wall panel.

2. A building wall panel as claimed in claim 1, wherein a layer of drywall is attached to at least one side of said panel.

3. A building wall panel as claimed in claim 1, wherein a layer of drywall is attached to both sides of said panel.

4. A building wall panel as claimed in claim 3, wherein insulation is interposed between the two layers of drywall.

5. A building wall panel as claimed in claim 1, wherein at least one electrical junction box is fixedly secured to said corrugated structural member within the thickness dimension of said panel.

6. A wall panel construction including in combination: first and second generally parallel and spaced end members each having a channel shaped cross section, first and second positioning tabs on opposed end portions of each of said first and second end members, first and second generally and spaced side members, said first side member having a channel shaped cross section and having opposed ends thereof engaging said first positioning tabs on corresponding ends of said first and second end members and being fixedly secured thereto, said second side member having a box shaped cross section and having opposed ends thereof engaging said second positioning tabs on corresponding ends of said first and second end members and being fixedly secured thereto, a portion of said box shaped cross section of said second side member overhanging said first and second end members and adapted to be received in the channel shaped cross section of a first side member of another wall panel, a structural member having first and second end portions, said first end portion of said structural member engaging said first end member intermediate said first and second end portions thereof, said second end portion of said structural member engaging said second end member intermediate said first and second end portions thereof, additional tabs on intermediate portions of said first and second members fixedly secured to said first and second end portions of said structural member to hold the same in position, said structural member having a width less than the distance between said first and second spaced side members.

7. A wall panel construction as claimed in claim 6, wherein said tabs are formed from a bottom wall of said channel shape of said first and second end members.

8. A wall panel construction as claimed in claim 7, wherein said structural member has a generally corrugated configuration with the depths of the corrugations being of a dimension on the order of the thickness dimension of said first and second end members.

9. A building wall panel as claimed in claim 8, wherein a layer of drywall is attached to at least one side of said panel.

10. A building wall panel as claimed in claim 8, wherein a layer of drywall is attached to both sides of said panel.

11. A building wall panel as claimed in claim 10, wherein insulation is interposed between the two layers of drywall.

12. A building wall panel as claimed in claim 8, wherein at least one electrical junction box is fixedly secured to said corrugated structural member within the thickness dimension of said panel.

13. A wall panel construction including in combination: first and second generally parallel and spaced end members each having a channel shaped cross section, first and second generally parallel and spaced side members, said first side member having opposed ends thereof engaging corresponding ends of said first and second end members and being fixedly secured thereto, said second side member having opposed ends thereof engaging corresponding ends of said first and second end members and being fixedly secured thereto, a structural member having first and second end portions, said first end portion of said structural member engaging said first end member intermediate said first and second end portions thereof, said second end portion of said structural member engaging said second end member intermediate said first and second end portions thereof, means fixedly securing said first and second end portions of said structural member to said first and second end members respectively, and said structural member having a width less than the distance between said first and second spaced side members.

14. A wall panel as claimed in claim 13, wherein a window frame opening is constructed which includes said structural member being divided into an upper portion and a lower portion, first and second spaced and parallel window frame members extending between and fixedly secured to said fist and second side members respectively, third and fourth spaced and parallel window frame members extending between and fixedly secured to said first and second window frame members, respectively, said upper portion of said structural member being secured to said first window frame member and said lower portion of said structural member being secured to said second window frame member.

15. A wall panel as claimed in claim 13, wherein a door frame opening is constructed which includes said structural member having only an upper portion, said lower end member being divided into first and second portions, a first door frame member extending between and fixedly secured to said first and second side members, second and third spaced and parallel door frame members extending between and fixedly secured to said first door frame member at their upper ends and to said first and second portions of said lower end member, respectively, at their lower ends, said upper portion of said structural member being secured to said first door frame member.

* * * * *